US005957280A

United States Patent [19]

Focke et al.

[11] Patent Number: 5,957,280

[45] Date of Patent: Sep. 28, 1999

[54] CUBOID PACKET FOR CIGARETTES AND BLANK FOR THE PACKET

[75] Inventors: Heinz Focke; Katrin Fehlings, both of Verden, Germany

[73] Assignee: Focke & Co. (GmbH & Co.), Verden, Germany

[21] Appl. No.: 08/928,082

[22] Filed: Sep. 12, 1997

[30] Foreign Application Priority Data

Sep. 13, 1996 [DE] Germany ..... 196 37 259

[51] Int. Cl.[6] ..... B65D 5/54

[52] U.S. Cl. ..... 206/264; 206/268; 206/273; 229/231; 229/234; 229/244

[58] Field of Search ..... 206/242, 245, 206/264, 265, 266, 268, 271, 273; 229/100.1, 231, 234, 244

[56] References Cited

U.S. PATENT DOCUMENTS

| | | | |
|---|---|---|---|
| 2,339,656 | 1/1944 | Shina | 206/264 |
| 2,508,193 | 5/1950 | Ringler . | |
| 2,767,900 | 10/1956 | Bouteloup . | |
| 2,913,165 | 11/1959 | Jacke | 206/264 |
| 2,944,726 | 7/1960 | McCauley . | |
| 3,018,031 | 1/1962 | Ahlbor et al. . | |
| 3,105,591 | 10/1963 | Ahlbor | 206/264 |
| 3,814,301 | 6/1974 | Niepmann | 206/264 |
| 3,823,865 | 7/1974 | Mechnick | 206/264 |
| 4,753,384 | 6/1988 | Focke et al. | 206/271 |
| 5,529,180 | 6/1996 | Paolucci et al. | 206/268 |

FOREIGN PATENT DOCUMENTS

| | | |
|---|---|---|
| 1761738 | 8/1971 | Germany . |
| 2940421 | 4/1981 | Germany . |
| 2408879 | 1/1985 | Germany . |
| 9316489 | 3/1994 | Germany . |
| 29604935 U | 6/1996 | Germany . |

*Primary Examiner*—B. Dayoan
*Assistant Examiner*—Luan K. Bui
*Attorney, Agent, or Firm*—Sughrue, Mion, Zinn, Macpeak & Seas, PLLC

[57] ABSTRACT

Hard packets for cigarettes are produced from thin cardboard. To form a removal aperture, a hinged lid (18) extending on one side, diagonally off-center, is provided. This lid forms in the region of an end wall (17) of the packet a line joint as a hinged connection to join the hinged lid (18) to the remaining portion of the packet. A lid side wall (21) forms a closing or insertion tab (36), which, after the packet has been used for the first time, can be pushed into an insertion position between a side wall (14) and the contents of the packet, i.e. a block of cigarettes (11).

6 Claims, 12 Drawing Sheets

CUBOID PACKET FOR CIGARETTES AND BLANK FOR THE PACKET

BACKGROUND OF THE INVENTION

The invention relates to a cuboid packet made of foldable, stiff packaging material such as (thin) cardboard, preferably for cigarettes as the contents of the packet, with a hinged lid which extends in an upper side corner region of a front wall and a back wall, of an upright side wall and an end wall, a hinge of the hinged lid being formed in the region of the end wall and an insertion-type closure with an insertion tab being formed on the hinged lid in the region of the side wall. In addition, the invention relates to blanks for the production of the above-mentioned packets.

So-called "hinge-lid packets" are a widely used type of packet for cigarettes. On a hinge-lid packet (made of thin cardboard), a lid is connected via a line joint in the region of a lid rear wall with a rear wall of a portion of the packet. On this type of packet, the whole upper region of the packet's contents lies open when the packet is in the opened position.

SUMMARY OF THE INVENTION

The object underlying the invention is to propose a cuboid packet, made of (thin) cardboard, for cigarettes, on which packet a hinged lid is arranged formed in the region of an upper corner, the packet being nonetheless of simple design and easy to handle.

In achieving this purpose, the packet according to the invention is characterised in that the hinged lid is double-layered in the region of a lid side wall corresponding to the packet side wall, with an inner side flap and an outer side flap, and in that the insertion tab is formed by different dimensions and/or geometric design of the side flaps, especially by a larger or longer outer side flap.

On the packet according to the invention, an insertion tab, necessary for the closed position of the hinged lid, is formed without any additional folding measures, namely only by separating lines, offset in height, between the hinged lid and the remaining portion of the packet in the region of the double-layer side wall. Due to this displacement, the single-layer insertion tab arises in the region of the lid side wall as a projecting end of the relevant (outer) side flap in relation to the other (inner) side flap.

This displacement is preferably formed by differently running closing edges of the hinge lid in the region of front wall and rear wall, especially by closing edges with different angles of inclination.

The packet configured in this way with a hinged lid in the upper corner region can also have, according to the invention, rounded upright packet edges—a so-called round-edge packet—with a continuation of the rounded edges in the region of the hinged lid. In analogous fashion, the packet can also be provided with polygonal or bevelled packet edges—a so-called octagonal packet.

The invention relates, furthermore, to blanks for packets of the described type, the blanks, consisting of thin cardboard being configured longitudinally extended with front wall, base wall, rear wall and end wall following one another in succession. Side end regions of the blank, lying opposite one another, are provided with perforations or punched-out lines to define regions for the hinged lid. In addition, a blank for an inner wrapping is so configured by perforations that, when the packet is opened for the first time via the hinged lid, an inner cap of the inner wrapping may be separated off in the region of the hinged lid.

Further details and features of the invention arise from the patent drawings. These show:

DESCRIPTION OF PREFERRED EMBODIMENTS

Figure 2:
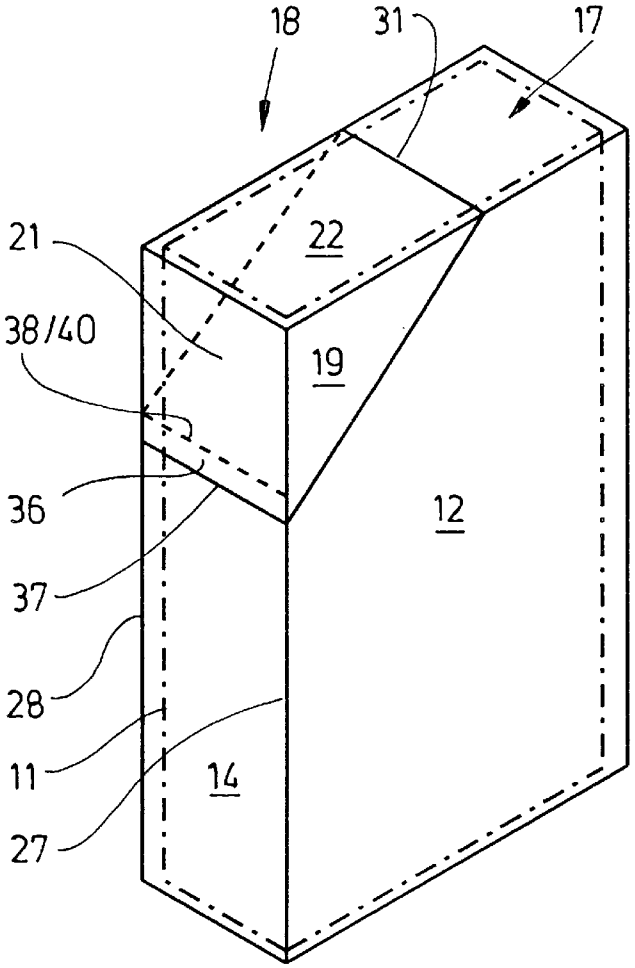
FIG. 2 another type of embodiment of the packet, likewise in closed position, FIG. 3 the packet according to FIG. 1 in opened position, likewise in perspective view, FIG. 4 a view analogous to FIG. 3 for the form of embodiment according to FIG. 2, FIG. 5 a round-edge packet with hinged lid FIG. 6 an octagonal packet with hinged lid, FIG. 7 a packet with a hinged lid in the embodiment of FIG. 1 to FIG. 4 in vertical section, before being opened for the first time, FIG. 8 a view corresponding to FIG. 7 with the hinged lid in closed position after being opened for the first time, FIG. 9 a spread-out blank for a packet according to FIG. 1 and FIG. 3, FIG. 10 a spread-out blank of a packet according to FIG. 2 and FIG. 4, FIG. 11 a spread-out blank for a round-edge packet according to FIG. 5, FIG. 12 a spread-out blank for a round-edge packet according to FIG. 6, FIG. 13 a spread-out blank for an inner wrapping of a group of cigarettes.

The embodiments, given by way of example and shown in the drawings are packets for cigarettes. A group of cigarettes is here surrounded by an inner wrapping 10. Thus a block of cigarettes 11 is formed which fills the inner space of the packet as the packet's contents.

The packets themselves consist of (thin) cardboard or similar foldable material. A preferably one-piece blank is here folded in such a way that large-surface walls lying opposite one another are produced, namely front wall 12 and rear wall 13. These are connected to one another by two upright, narrow side walls 14 and 15. A base wall 16 and an end wall 17 complete the packet.

A hinged lid serves to open and close the packet. Said lid is formed in the region of an upper side edge of the packet and extends diagonally. The hinged lid 18 is a section of the packet and has a lid front wall 19 and lid rear wall 20 as part of the front wall 12 and rear wall 13. An upper region of a side wall 14 forms a lid side wall 21. A partial region of the end wall 17 is a lid end wall 22.

The hinged lid 18 or a removal aperture, closable by the lid and extending diagonally, is delimited in the region of front wall 12 and rear wall 13 by abutting edges 23, 24, which extend from upper transverse edges 25, 26 associated with the end wall 17 of the packet, sloping down to (upright) longitudinal edges 27, 28. The latter form upright side delimitations of the side wall 14. The abutting edges 23, 24 with corresponding lid abutting edges 29, 30 in the region of front wall 12 and rear wall 13, run in a straight line in the present embodiments, but can also be arcuate or of some other design. Through the present form of the abutting edges 23, 24 on the one hand and lid abutting edges 29, 30 on the other hand, the lid front wall 19 and the lid rear wall 20 are triangular in configuration.

The hinged lid 18 is connected in the region of the end wall 17 with the remaining portion of the packet. Between end wall 17 and lid end wall 22 there extends a transverse line joint 31.

The packet is so designed that the side wall 14 and the lid side wall 21 are configured double-layered, i.e. they consist of two walls or folding flaps which overlap one another, at least predominantly. These are side flaps 32, 33 or lid side flaps 34, 35. An outer side flap 32 is connected with the front wall 12 and an inner side flap 33 with the rear wall 13. The side flaps 32, 33, and correspondingly, the lid side flaps 34, 35, are connected to one another by gluing to form the side wall 14 or the lid side wall 21.

Figure 1:
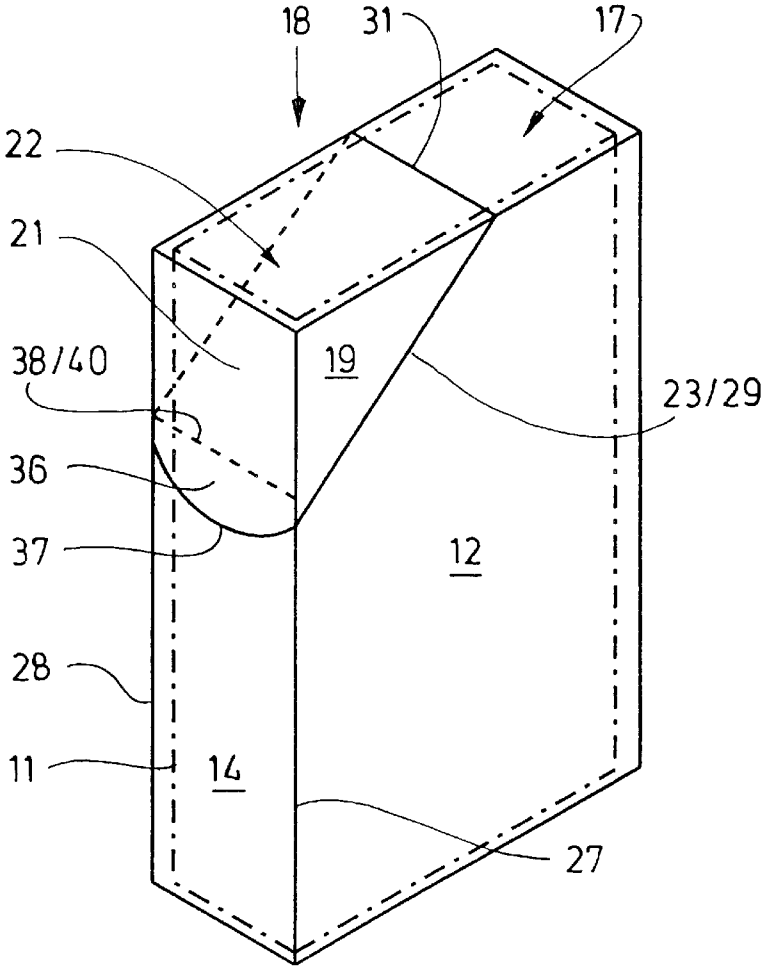
FIG. 1 a cigarette packet with closed hinged lid, in perspective view.
Figure 8:
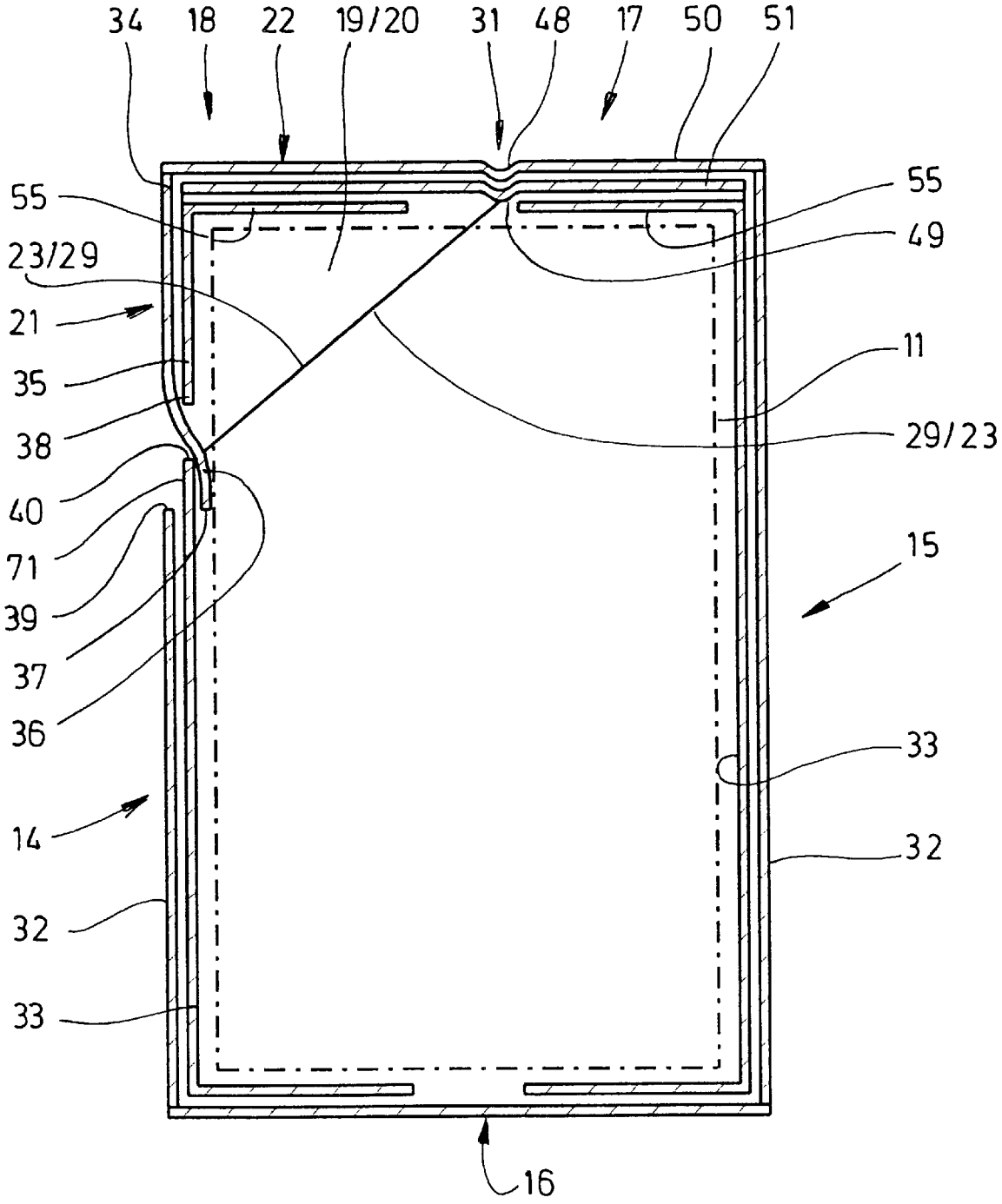
Figure 9:
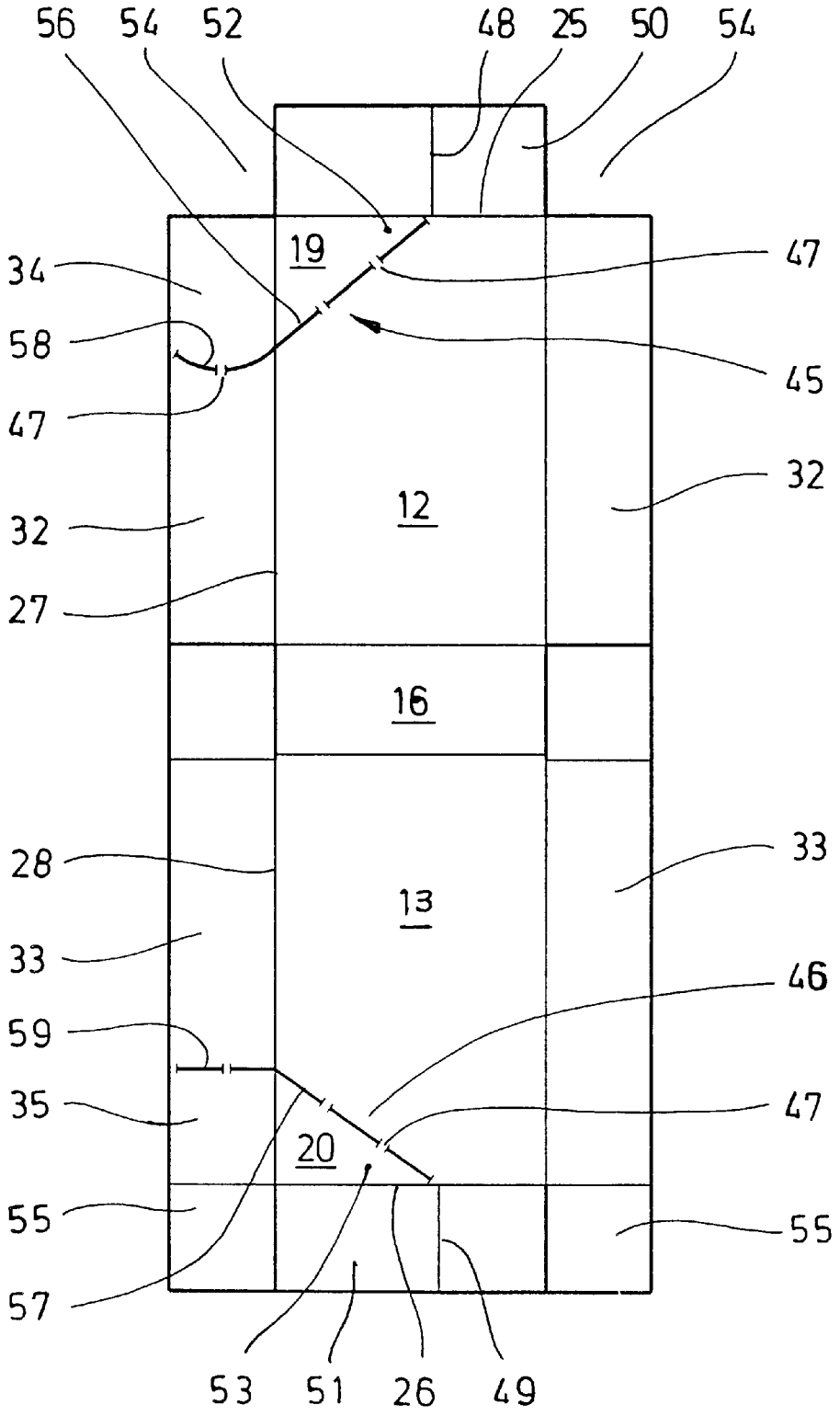
Figure 10:
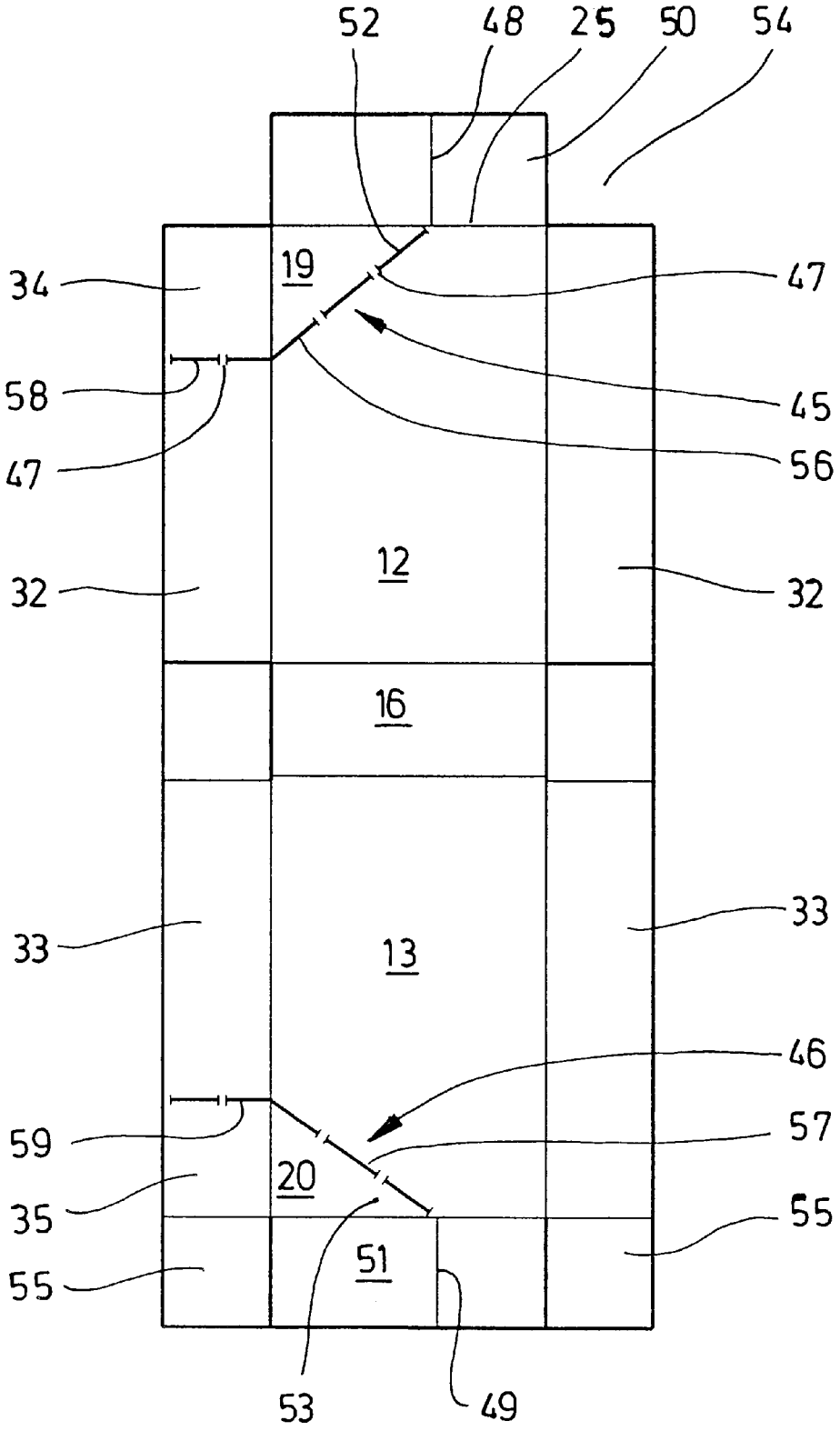

The side flaps 32, 33 and lid side flaps 34, 35 form transverse (closing) edges which correspond with one another and which lie fitting into one another before the packet is used for the first time (FIG. 1, FIG. 2). In order to guarantee a stable closed position of the hinged lid 18, after the packet has been opened for the first time, an insertion-type connection for the lid is provided on the examples shown. On the hinged lid 18, namely on its lid side wall 21, a closing tab or insertion tab 36 is formed which is brought into an insertion position in the closed position of the packet (FIG. 8). In the previously mentioned embodiment, the insertion tab 36 extends on the inner side of the side wall 14 or on the inner side of the inner side flap 33 between the latter and the contents of the packet, i.e. especially the block of cigarettes 11.

The insertion tab is produced, without the addition of any extra material, simply through the design of portions of packet walls. As shown, closing edges 37, 38 in the region of the lid side wall 21 are arranged offset to one another. Corresponding to this, counter-edges 39, 40 of the side wall 14 or of the side flaps 32, 33 are likewise offset to one another in respect of their height. The outer lid side flap 34 thus has a greater measurement in the vertical direction than the inner lid side flap 35. In the closed position, the lid side flap 34 protrudes downwards over the upper region of the inner side flap 33, i.e. over the counter-edge 40, forming the closing or insertion tab 36. In this way, the lower region of the lid side flap 34 can be led as an insertion tab 36 between the inner side flap 33 and the packet's contents, namely the block of cigarettes 11 (FIG. 8). The closed position is thus fixed as a result of the clamping force applied to the insertion tab 36.

The closing or insertion tab 36 can be designed in different ways, by corresponding configuration of the edges 37 . . . 40 corresponding with one another. In an advantageous embodiment according to FIG. 1 and FIG. 3, the insertion tab 36 is configured tongue-like, namely with an arcuate delimitation of the insertion tab 36 (closing tab 37). This form arises through a corresponding severance cut in the region of the outer side flap 32 or of the lid side flap 34 forming the corresponding edges, namely closing edge 37 and counter-edge 40. The tongue-shaped insertion tab 36 can be delimited in the shape of a circular arc in this embodiment.

Figure 4:
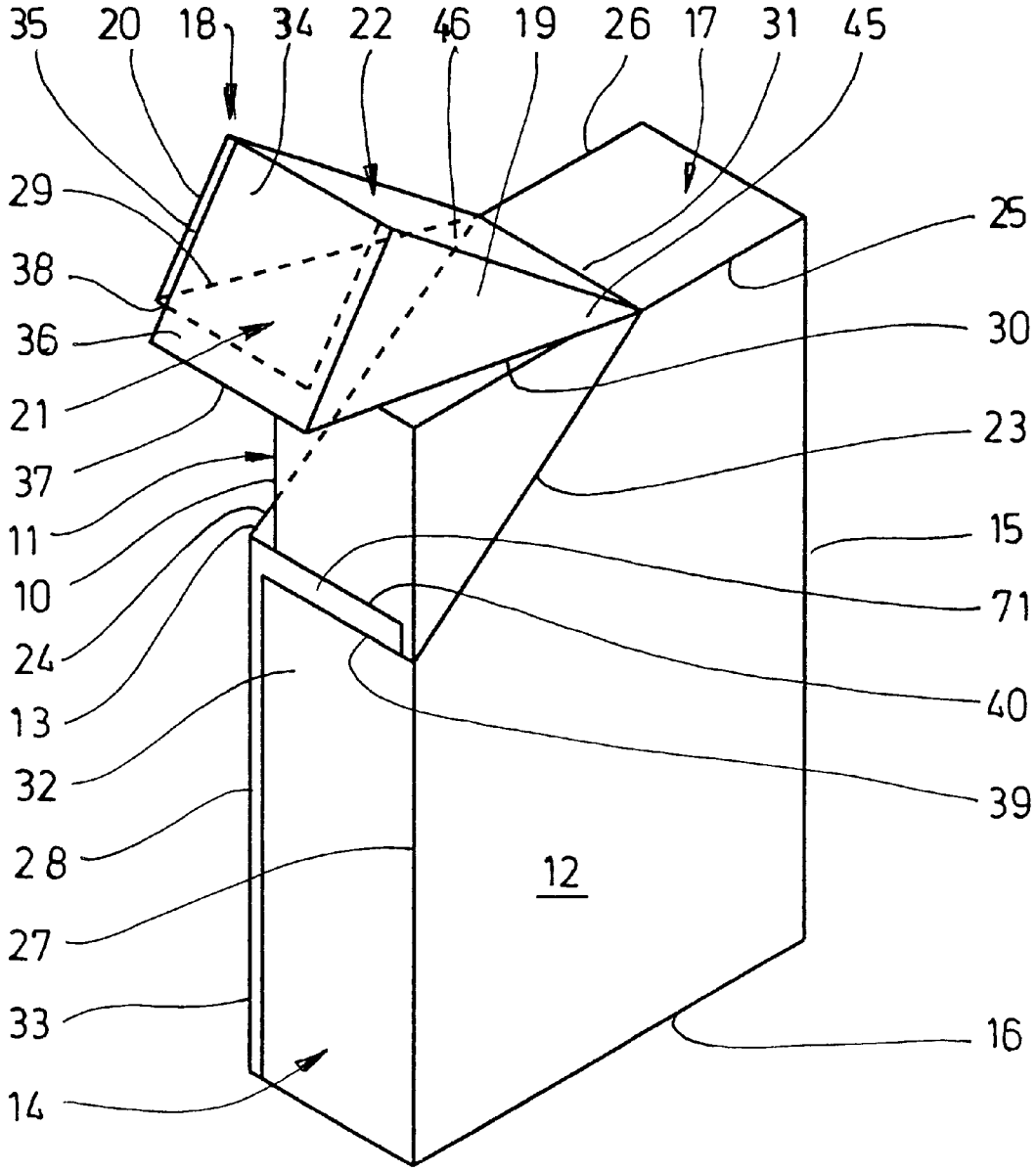

In the simpler embodiment according to FIG. 2 and FIG. 4, the closing edge 37 and the counter-edge 39 are configured as straight lines, namely as severance cuts running transversely to the longitudinal edges 27, 28.

Because of the given design of the packet, leading the insertion tab 36 into the closed position (FIG. 8) is made easier or made possible by the fact that the insertion tab 36, as a portion of the outer lid side flap 34, is free on the one side and only directly connected on the other side with the lid front wall. On this side, however, the inner side flap 33 is free, namely not directly connected with a neighbouring wall (front wall 12).

The insertion tab 36 arises from a differing design of the lid front wall 19 and lid rear wall 20, namely through their being of different size. This design arises in turn through differing inclination (angles) of the abutting edges 23, 24 or lid abutting edges 29, 30. These proceed from the ends of the line joint 31 and terminate offset in respect of their height to the longitudinal edges 27, 28. The insertion tab 36 arises from this displacement.

Figure 6:
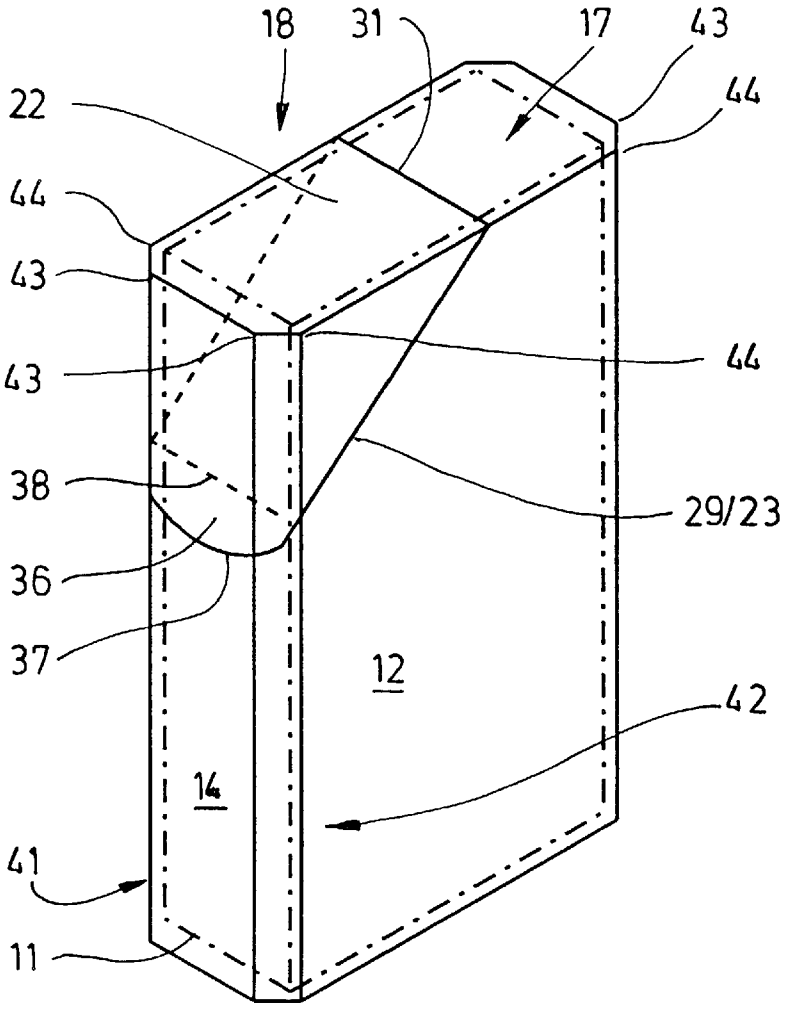
Figure 5:
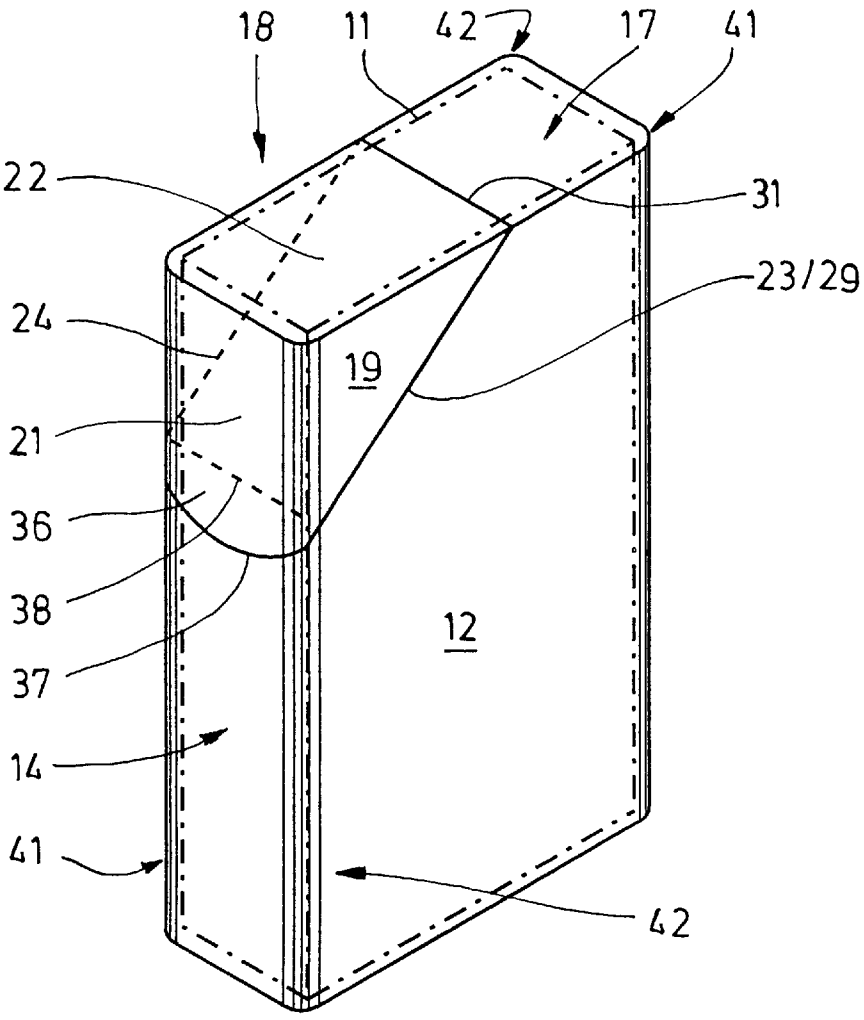
Figure 6:
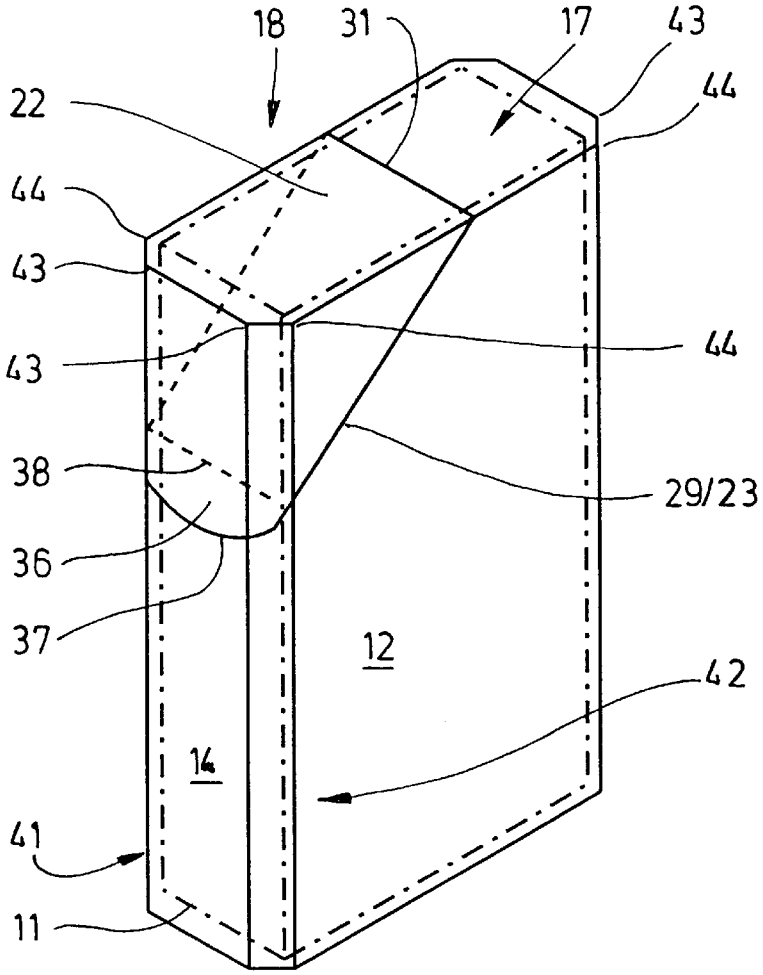
Figure 5:
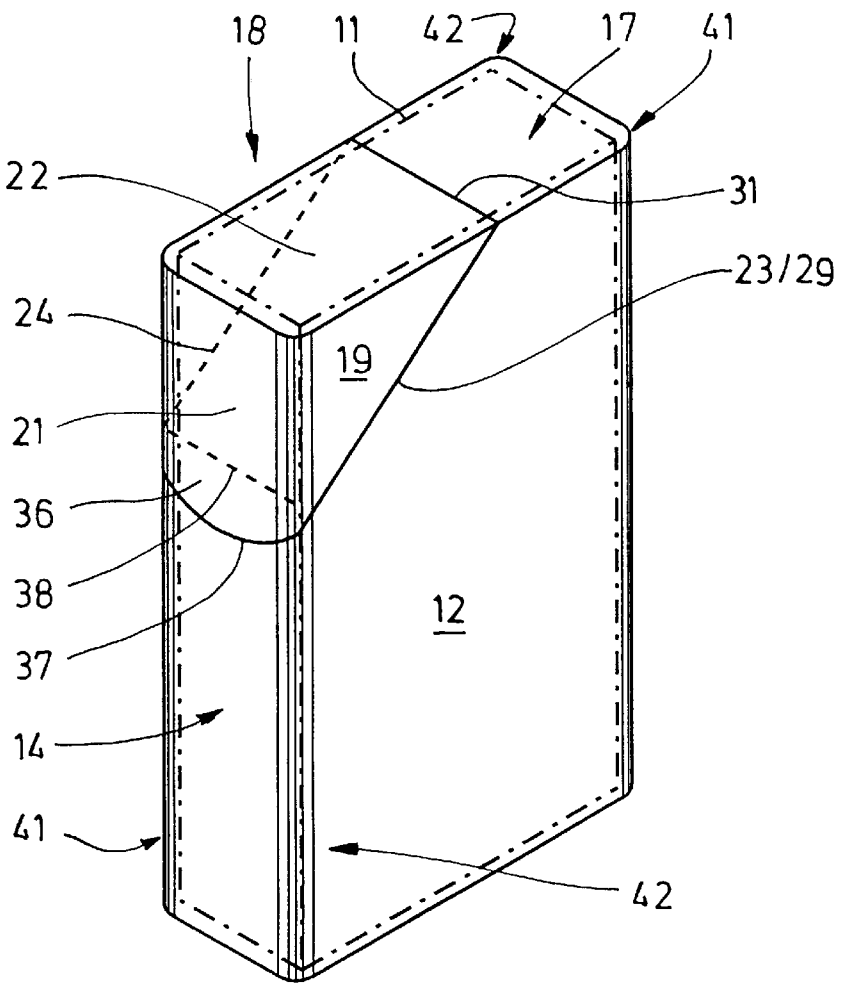
Figure 7:
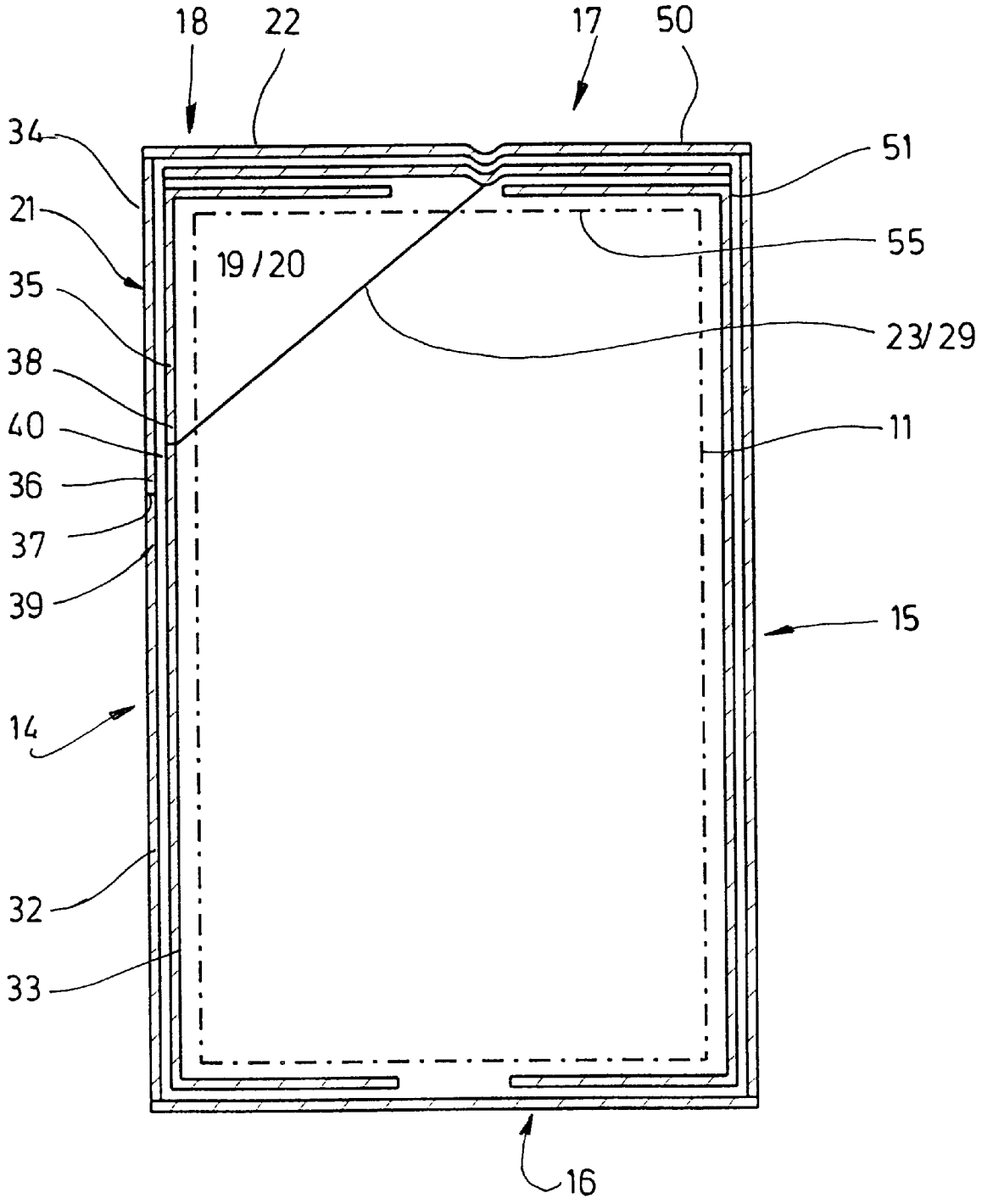

A further special characteristic arises from FIGS. 5 and 6. What is shown is the application of the described principle of construction of a hinged lid 18 to a round-edge packet (FIG. 5) and an octagonal packet (FIG. 6). On the first-mentioned type of packet, the upright longitudinal edges 27 and 28 and opposite longitudinal edges 41, 42 are configured rounded, namely with a cross-section approximately in the shape of quarter of a circle, corresponding to the dimensions of the cigarettes. Severance cuts or punched-out lines are placed in such a way that the insertion tab 36 is led as far as the region of the rounded longitudinal edges 27, 28, namely ends roughly in the middle of same. The abutting edges 23, 24, running at an angle, or lid abutting edges 29, 30 join on to this.

The octagonal packet according to FIG. 6 is configured in analogous fashion. The longitudinal edges 27, 28 and 41, 42 are bevelled in this example. This produces two individual edges 43, 44 for each longitudinal edge 27, 28; 41, 42. Here, too, the insertion tab 36 extends into the region of a material strip between individual edges 43, 44 of the longitudinal edges 27, 28. It adjoins the abutting edge 23, 24 with lid abutting edge 29, 30.

In the present embodiments, the packet is manufactured from a one-piece blank (FIG. 9 to FIG. 12). The blank can be designed differently, for instance also according to the "cross-wrap" principle. It is, however, necessary for the side wall 14 and correspondingly the lid side wall 21 in the region of the hinged lid to be configured as having at least two layers.

The blank is so designed that perforations to form the hinged lid 18 are already applied during the manufacture of the blank. As can be seen from FIG. 9, line-shaped perforations 45, 46 are applied to end regions, facing one another, of the longitudinallu-extended blank. These are punched-out lines which are broken up by vestigial connections 47 which may be severed. The perforations 45, 46 define the edges 23, 24; 29, 30; 37, 38; 39, 40 produced when the packet is opened for the first time. The special characteristic consists in the fact that the perforations 45, 46 run at different angles with a straight limb 56, 57 in the region of the front wall 12 and rear wall 13. An angle 52 for limb 56 in the region of the front wall 12 is larger than an angle 53 for the limb 57 in the region of the rear wall 13. In this way, the described displacement is produced in the region of the (double-layer) side wall 14 or lid side wall 21. Differently shaped limbs 58, 59 of the perforations 45, 46 join on to the limbs, running at an angle, of the perforations 45, 46 in the region of the side flaps 32, 33. Limb 58 is shaped arcuate in FIG. 9 to delimit a corresponding closing or insertion tab 36 of the embodiment according to FIGS. 1 and 3. Limb 59 is in a straight line and transverse.

The blank is also already provided with embossings 48, 49 in the region of end flaps 50, 51, to form the line joint 31.

On the embodiments, given by way of example and shown here, the end wall 17 is configured double-layered, namely consisting of the end wall flaps 51. 51 overlapping and connected to one another. Both have embossed lines 48, 49, which lie at the same place on the finished packet (FIG. 8) and thus together form the line joint 31.

A further special characteristic consists in the fact that side sections 54 are formed on the blanks in the region of the external wall flaps 50 by omitting corner flaps 55 which are present in the region of the inner end flap 51. These corner flaps 55 are connected to the side flaps 33 or lid side flaps 35.

Figure 11:
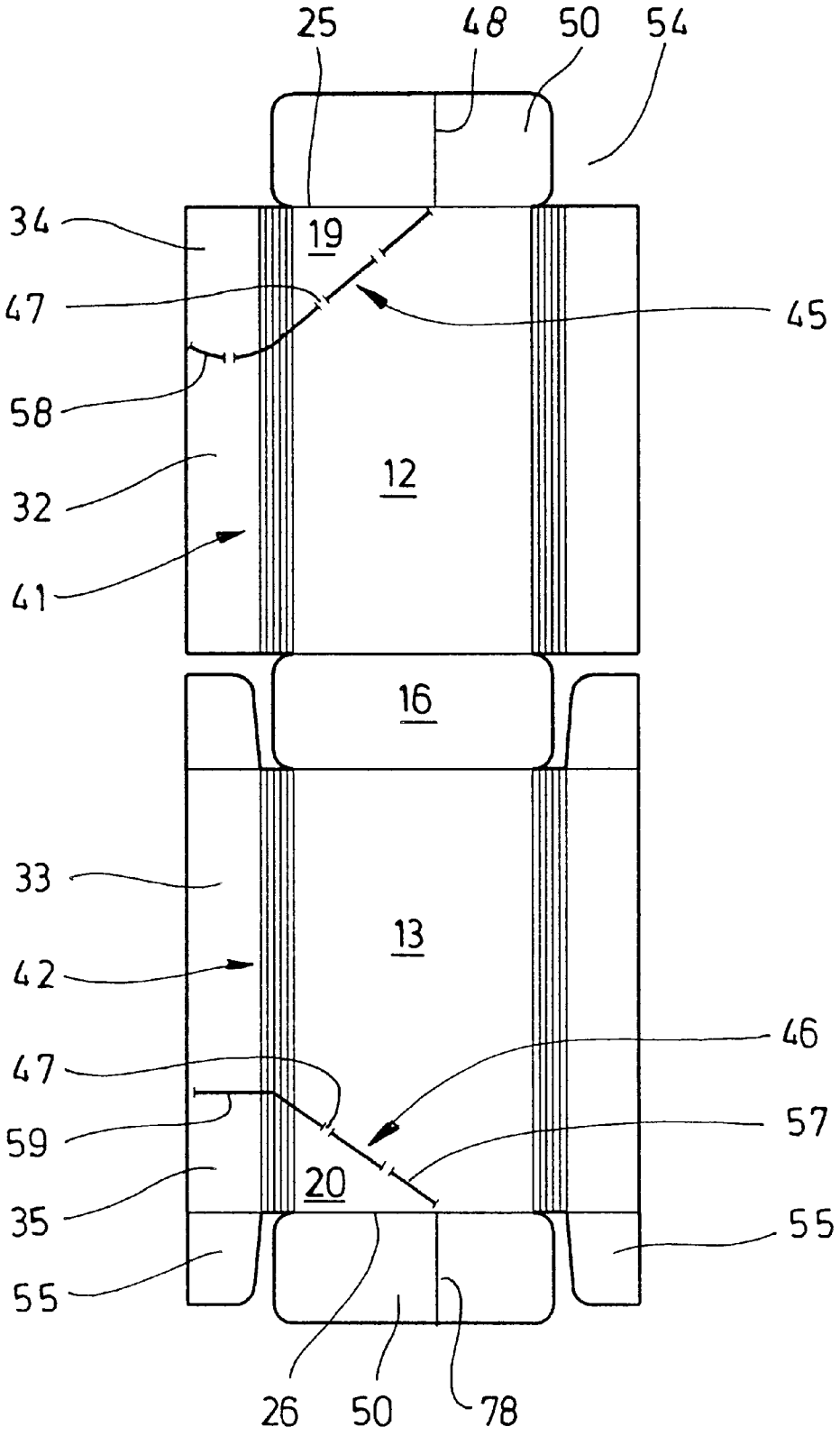
Figure 12:
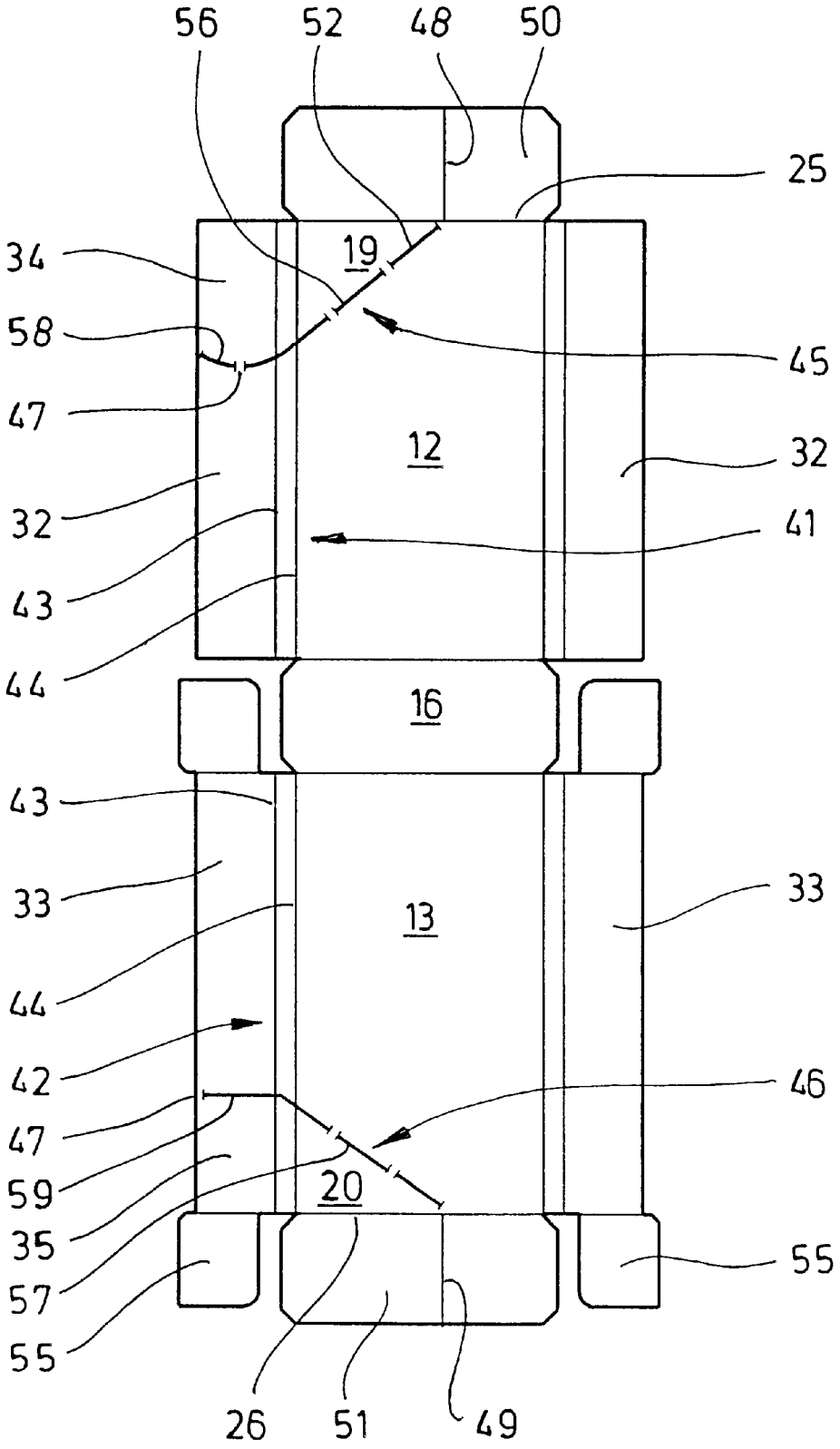

FIG. 11 and FIG. 12 show blanks for round-edge packets (FIG. 5) or octagonal packets (FIG. 6), in each case with perforations 45, 46 for the hinged lids 18 described. On these blanks, too, there are no corner flaps in the region of the outer end flap 50.

Figure 13:
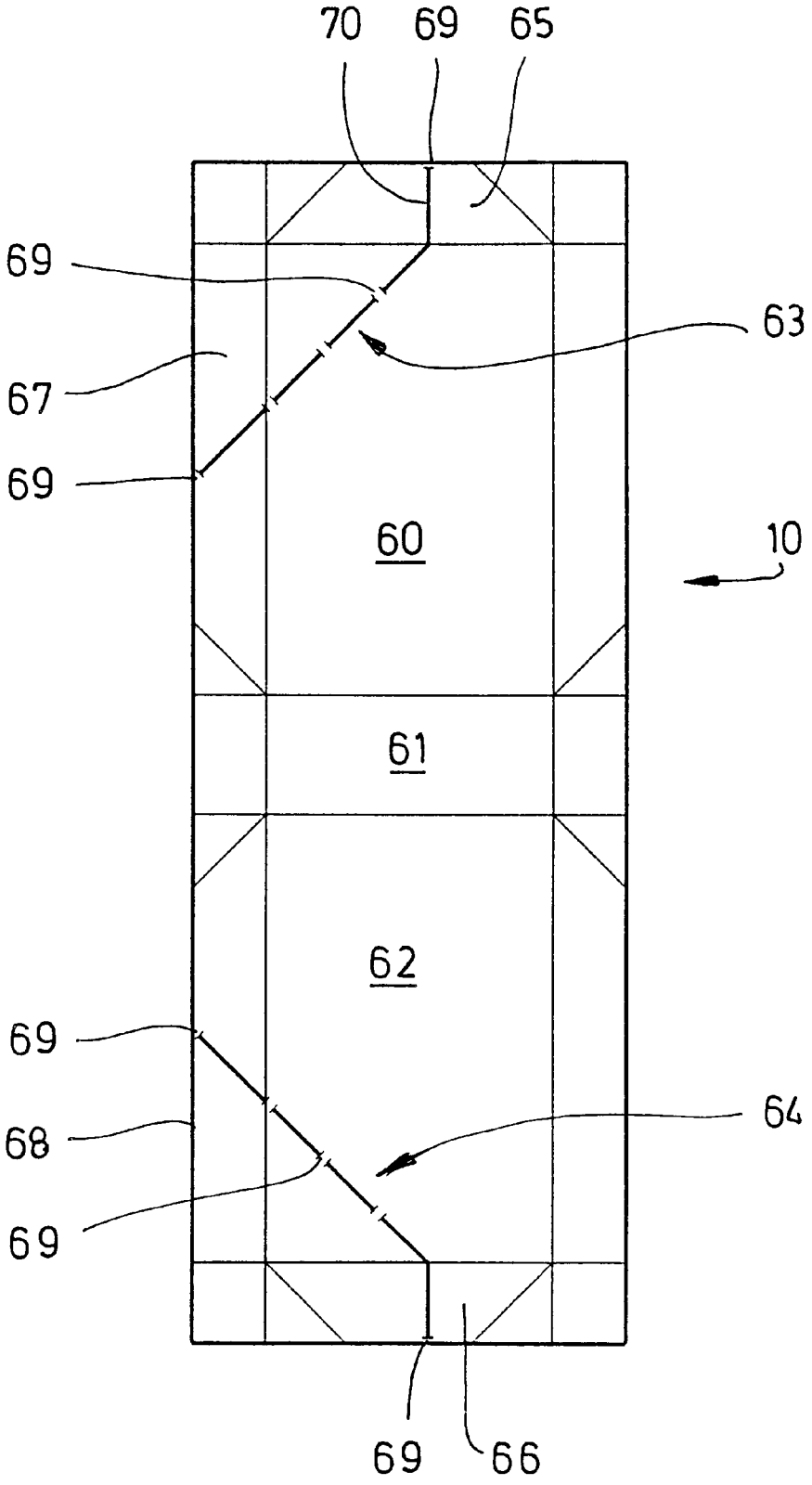

FIG. 13 shows a further special characteristic. This concerns the design of a blank for the inner wrapping 10 made of paper, tinfoil or some other suitable material. The inner wrapping 10 is constructed in such a way that a front surface 60, a base surface 61 and a rear surface 62 follow one another in succession, such that the inner wrapping 10 forms a longitudinally extended rectangular blank. Folds are to be found in the region of the end wall and of the side walls 14 and 15 of the packet on the basis of corresponding folding flaps of the inner wrapping 10.

In the region of the hinged lid 18, the inner wrapping 10 is provided with a top which may be taken away when the packet is opened for the first time. This corresponds roughly in size to the size of the hinged lid 18. Thus the contents of the packet lie open in the region of the hinged lid 18 once this top of the inner wrapping 10 has been removed.

The top of the inner wrapping 10 is formed by corner regions of the inner wrapping 10 lying opposite one another. Cutting lines 63, 64 are located here. They extend diagonally from an end flap 65 or 66, running at an angle in the region of the front surface 60 or rear surface 62 and then in the region of side folding flaps 67, 68 of the inner wrapping. The cutting lines 63, 64 are broken up by vestigial connections 69. When the packet is opened or the top removed, these vestigial connections 69 are severed. The vestigial connections 69 are positioned in such a way that a vestigial connection 69 of this type is located in each case at the ends of the cutting lines 63, 64.

A further special characteristic consists in the fact that the cutting lines 63, 64 form a rectilinear transverse limb 70 in the region of the end flaps 65, 66. The relative position of the cutting lines 63, 64, or the inclination of the section of same running at an angle, is chosen to be such that they correspond to the course of perforations 45, 46.

Figure 3:
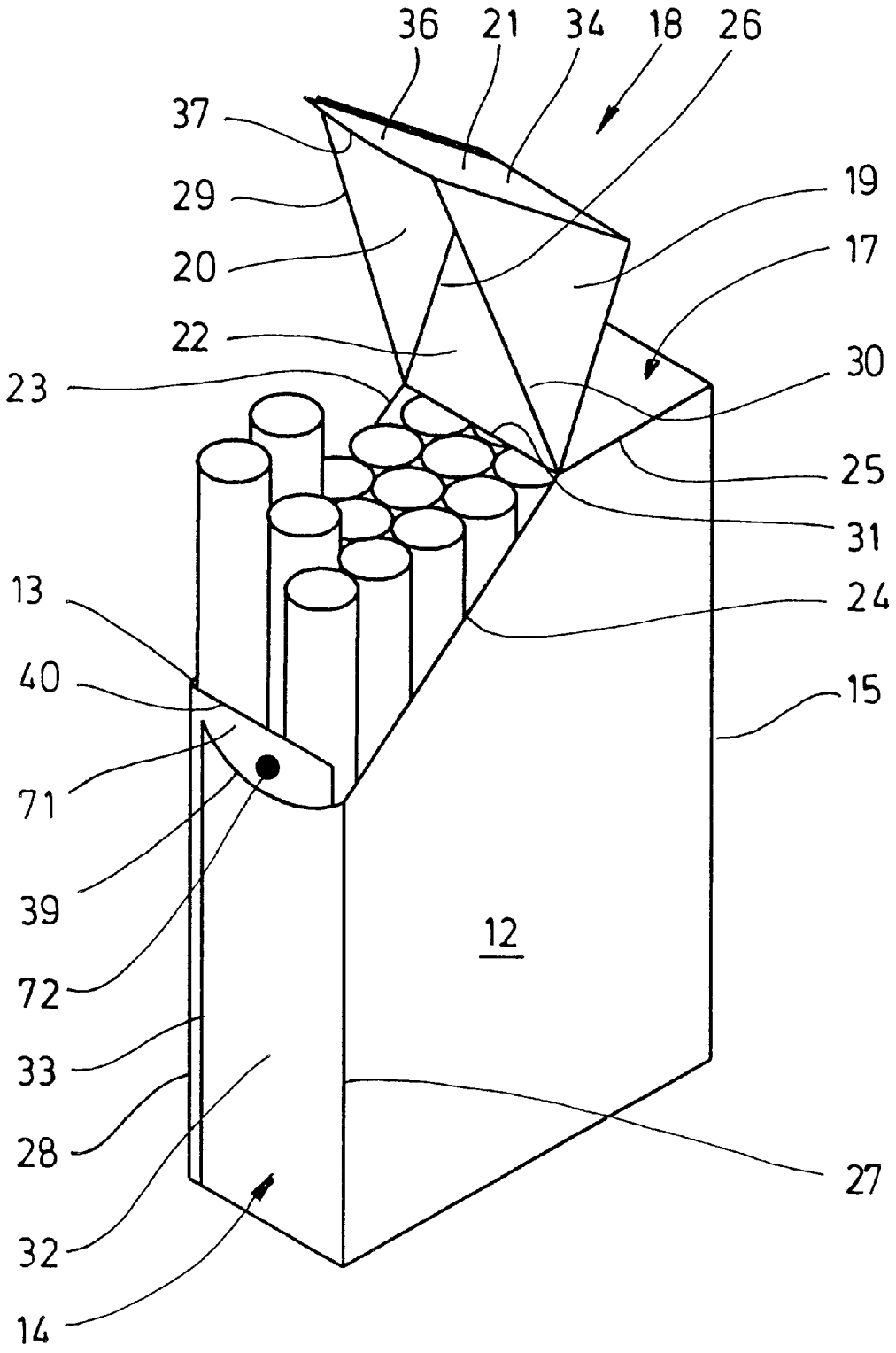

The embodiments, given by way of example and shown and described here, of a (hard) packet with diagonally orientated hinged lid 18 can undergo various modifications. Thus the insertion tab 36 described and shown can alternatively be used as a contact tab, which in the closed position of the packet lies next to the inner wall, namely the inner side flap 33 or a projecting end 71 formed by the offset punched-out lines (FIG. 3). In the region of this projecting end 71, a permanently acting adhesive agent can be applied, for example a glue spot of a (known) permanently effective glue. The insertion tab 36 acting as closing tab is held in the closed position by the glue spot 72.

In addition, it is possible so to design the blanks for the packet in all embodiments that the base wall 16 acts as end wall, i.e. the end flaps 50, 51, lying the one above the other, form a base wall. On this alternative, the perforations 45, 46 are arranged in the central region of the longitudinally extended blanks in such a way that two divergent perforations are produced proceeding from the (central) end wall (corresponding to base wall 16). In this case, the end wall of the packet is single-layer.

What is claimed is:

1. An elongated rectangular blank for an inner wrapping (10) of a group of cigarettes in a cuboid packet having at least a front wall (12), a base wall (16), a rear wall (13), two side walls (14, 15), and an end wall (17), wherein in the blank:

a) regions for a front surface (60), base surface (61) and rear surface (62) are formed following one another in the longitudinal direction of the elongated rectangular blank, b) in the front surface (60) and rear surface (62), side folding flaps (67, 68) are formed as a side wrapping of the group of the cigarettes, c) end flaps (65, 66) adjoin narrow ends of the front surface (60) and the rear surface (62) to cover the cigarettes at upper ends thereof, d) cutting lines (63, 64) with vestigial connections (69) are formed on corner regions of the blank lying opposite one another, e) the cutting lines extend from free edges of the end flaps (65, 66) to free edges of the folding flaps (67, 68), f) in the front surface (60) and the rear surface (62) and in the adjacent folding flaps (67, 68), the cutting lines run continuously in a straight line, and g) in the end flaps (65, 66) a transverse limb (70) is formed, offset through 90°.

2. A cuboid cigarette packet comprising a hinged lid (18) which extends in a packet upper side corner region defined by a packet front wall (12), a packet rear wall (13), an upright packet side wall (14) and a packet end wall (17), a line joint (31) of the hinged lid (18) being formed in the packet end wall (17), and a closure insertion tab (36) being formed on the hinged lid (18) adjacent the packet side wall (14), wherein:

the packet and the hinged lid (18) comprise a common one-piece blank made of foldable, stiff packaging material;

the packet side wall (14) is double-layered, with packet inner and outer side flaps (32, 33) which overlap each other;

an upper region of the packet side wall (14) forms a lid side wall (21), and comprises an outer lid side flap (34) and an inner lid side flap (35);

the outer lid side flap (34) has, for the purpose of forming the insertion tab (36), a greater length than the inner side flap (35); and a lower closing edge (38) of the inner lid side flap (35) is offset upwardly relative to a lower closing edge (37) of the outer lid side flap (34), and, correspondingly, an upper edge (39) of the packet outer side flap (32) is offset downwardly relative to an upper edge (40) of the packet inner side flap (33).

3. A packet according to claim 2, characterized in that the insertion tab (36) of the hinged lid (18) has a shape of a rounded tongue so that the lower closing edge (37) of the outer lid side flap (34) is circular and in that the inner lid side flap (35) has a different shape so that the lower closing edge (38) of the inner lid side flap (35) is straight.

4. A packet according to claim 2, characterized by rounded upright longitudinal packet edges (41, 42), the insertion tab (36) extending into the rounded longitudinal edges (41, 42).

5. A packet according to claim 2, characterized by beveled upright longitudinal packet edges (41, 42) with two parallel individual edges (43, 44) spaced from one another, the insertion tab (36) extending into the beveled longitudinal edges (41, 42).

6. A packet according to claim 2, characterized in that the packet end wall (17) is double-layered and consists of two packet end flaps (50, 51) overlapping one another, in that the lid end wall (22) is correspondingly double-layered, and in that the line joint (31) is formed by embossed lines extending over both end flaps (50, 51).

* * * * *